US005088611A

United States Patent [19]

Katz

[11] Patent Number: 5,088,611

[45] Date of Patent: Feb. 18, 1992

[54] CONTAINER OVERCAP SEAL

[75] Inventor: Philip R. Katz, Kinnelon, N.J.

[73] Assignee: Cosrich Incorporated, Perth Amboy, N.J.

[21] Appl. No.: 618,988

[22] Filed: Nov. 28, 1990

[51] Int. Cl.[5] ..... B65D 51/18

[52] U.S. Cl. ..... 215/230; 215/227; 215/246

[58] Field of Search ..... 215/230, 246, 227, 228, 215/273, 275, 277, 278; 446/327, 328, 365, 366, 74; D9/444, 445, 451, 436, 311, 314

[56] References Cited

U.S. PATENT DOCUMENTS

| | | | |
|---|---|---|---|
| D. 22,168 | 1/1893 | Librowicz | D9/451 |
| D. 22,324 | 4/1893 | Librowicz | D9/451 |
| D. 190,238 | 5/1961 | Blake | D9/451 X |
| D. 266,989 | 11/1982 | Herwood | D9/311 |
| 1,346,176 | 7/1920 | Chambers | 446/74 X |
| 2,096,324 | 10/1937 | Guthrie | 215/278 |
| 2,270,018 | 1/1942 | Davis | 215/246 |
| 2,667,986 | 2/1954 | Perelson | 215/228 |
| 2,830,722 | 4/1958 | Darmstadt | 215/320 X |
| 2,917,766 | 12/1959 | Ciffo | 215/227 X |
| 3,051,341 | 8/1962 | Mead | 446/74 X |
| 3,085,709 | 4/1963 | Klein | 215/228 X |
| 3,507,416 | 4/1970 | Douglas et al. | 446/74 X |
| 3,677,429 | 7/1972 | LaBarge | 215/11.5 X |
| 3,866,803 | 2/1975 | Kipfmueller | 215/227 X |
| 4,177,934 | 12/1979 | Hammes et al. | 215/275 X |
| 4,624,378 | 11/1986 | Sawicki | 215/230 |
| 4,830,208 | 5/1989 | Osting et al. | 215/252 |
| 4,903,848 | 2/1990 | Chattman | 215/227 |
| 4,957,210 | 9/1990 | Kusz | 215/220 |

*Primary Examiner*—Stephen P. Garbe
*Assistant Examiner*—Vanessa Caretto
*Attorney, Agent, or Firm*—David L. Davis

[57] ABSTRACT

A container overcap seal arrangement including flanges formed on the neck of the container and at the distal end of a decorative overcap. A band of shrink wrap plastic material is placed around the flanges and heated sufficiently so that it shrinks into close engagement with the flanges.

6 Claims, 1 Drawing Sheet

CONTAINER OVERCAP SEAL

BACKGROUND OF THE INVENTION

This invention relates to container closures and, more particularly, to an arrangement for sealing an overcap to a container.

Products such as bubble bath and shampoo for small children are often packaged with a decorative overcap, perhaps showing a favorite cartoon character, over the standard screw-on closure cap of the container. To prevent the decorative overcap from being removed from the container while it is on the shelf in the store prior to purchase, some means for sealing the overcap to the container must be provided. It has been proposed to encase the entire assembly (i.e., container, closure cap and decorative overcap) within a cocoon of shrink wrap material. However, this is relatively expensive and time consuming to effect. In addition, the shrink wrap material tends to deform the decorative overcap, which is typically of hollow construction, which detracts from its otherwise pleasing appearance. It is therefore a primary object of the present invention to provide an improved arrangement for sealing a decorative overcap to a container.

SUMMARY OF THE INVENTION

The foregoing and additional objects are attained in accordance with the principles of this invention by providing a closure for a container comprising a generally cylindrical neck portion of the container, the neck portion having an opening for accessing the contents of the container and a circumferential flange at least partially surrounding the neck portion and spaced from the opening, a cup-like closure cap embracing the neck portion between the opening and the flange for covering the opening, an overcap having a downwardly depending cylindrical skirt sized so as to fit closely around the closure cap, the skirt having a circumferential flange at its distal end at least partially surrounding the skirt, and means for removably securing the overcap skirt flange to the neck portion flange.

In accordance with an aspect of this invention, there is provided a method of sealably closing a container having a neck portion with an opening for providing access to the contents of the container and a cup-like closure cap embracing the neck portion for covering the opening, comprising the steps of providing a circumferential flange at least partially surrounding the neck portion and spaced from the opening beyond the region embraced by the closure cap, providing an overcap having a downwardly depending cylindrical skirt sized so as to closely fit around the closure cap, the skirt being at least partially surrounded by a circumferential flange at its distal end, placing the overcap skirt over the closure cap, and sealing the overcap skirt flange to the neck portion flange.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
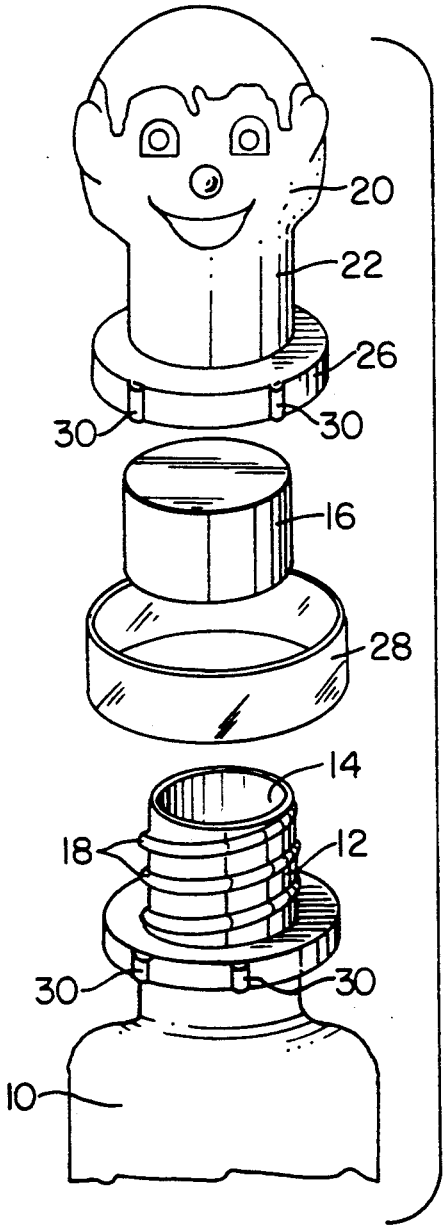
FIG. 1 is an exploded perspective view of a container, closure cap, decorative overcap and seal band constructed in accordance with the principles of this invention.

Referring to the drawings, shown therein is a container 10 including a neck portion 12 with an opening 14 for accessing the contents of the container 10. As is conventional, a cup-like closure cap 16 is provided for embracing the neck portion 12 so as to cover the opening 14. As shown in FIG. 1, the neck portion 12 may be formed with an external screw thread 18 and the closure cap 16 may be formed with a mating internal screw thread (not shown), but this invention also applies if the cap 16 merely slides onto the neck portion 12, or is fastened thereto in any other conventional manner.

For covering the closure cap 16, there is provided a decorative overcap 20 which may be formed to display a favorite cartoon character or the like. The overcap 20 includes a downwardly depending cylindrical skirt portion 22 which is sized so as to fit closely around the closure cap 16. Preferably, the overcap 20 is hollow and removable from the closure cap 16 after purchase so that it may be utilized as a finger puppet or decorative item.

According to the present invention, the container 10 is formed with a circumferential flange 24 (referred to as a "tinture" in the trade) at least partially surrounding the neck portion 12 below the screw thread 18. If closure is not effected through the use of screw threads, the flange 24 is spaced from the opening 14 beyond the region embraced by the closure cap 16. Preferably, the flange 24 completely surrounds the neck portion 12.

Further, according to this invention, the skirt 22 of the overcap 20 is formed at its distal end with a circumferential flange 26 which at least partially surrounds the skirt portion 22. Preferably, the flange 26 completely surrounds the skirt portion 22. The flanges 24 and 26 preferably have substantially the same diameter.

Figure 2:
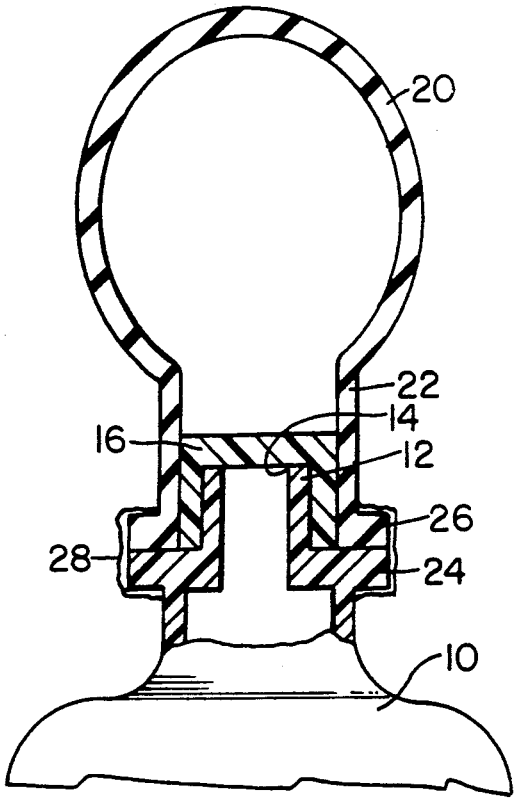
FIG. 2 is a cross-sectional view showing the elements shown in FIG. 1 assembled according to this invention.

According to this invention, a band 28 of shrink wrap plastic is provided. The band 28 is larger in diameter than the flanges 24 and 26 so that for assembly it is placed on the container 10 at or below the flange 24. The closure cap 16 is then secured to the container 10 and the overcap 20 is placed over the closure cap 16 so that the flange 26 abuts the flange 24. (Alternatively, the overcap 20 may be placed on the closure cap 16 prior to installation of the closure cap 16 on the container 10.) The band 28 is then positioned so that it surrounds both of the flanges 24 and 26. Sufficient heat is then applied to the band 28 to cause the band 28 to shrink into close engagement with the flanges 24 and 26, as is clearly shown in FIG. 2.

In order to prevent relative rotation of the overcap 20 and the container 10 within the shrunken band 28, the flanges 24 and 26 are formed with irregularities, such as the ribs 30. To enhance the visual appearance of the overcap 20, the skirt 22 and the flange 26 form part of the motif of the decorative overcap 20. Thus, for example, if the overcap 20 is formed as a female head, the flange 26 can be given the appearance of a necklace surrounding the neck 22, where the irregularities 30 form part of the design of the necklace.

Accordingly, there has been disclosed an improved container overcap seal arrangement and method. While a preferred embodiment has been disclosed, it will be apparent to one of ordinary skill in the art that various modifications and adaptations to the disclosed arrangement can be made without departing from the spirit and scope of this invention, which is only intended to be limited by the appended claims. Thus, instead of utilizing a band of shrink wrap plastic, this invention may also be practiced by wrapping adhesive tape, which may be of the expandable type, around the two flanges.

I claim:

1. A closure for a container comprising:

a generally cylindrical neck portion of said container, said neck portion having an opening for accessing the contents of said container and a circumferential flange at least partially surrounding said neck portion and spaced from said opening;

a cup-like closure cap embracing the neck portion between the opening and the flange for covering the opening;

an overcap having a downwardly depending cylindrical skirt sizes so as to fit closely around said closure cap, said skirt having a circumferential flange at its distal end at least partially surrounding said skirt; and means for removably securing said overcap skirt flange to said neck portion flange, comprising a band of shrink wrap plastic;

wherein both said flanges are formed with irregularities so as to prevent relative rotation within said band of shrink wrap plastic.

2. The closure according to claim 1 wherein both said flanges completely surround their respective neck portion and skirt.

3. The closure according to claim 2 wherein said flanges have substantially the same diameter.

4. The closure according to claim 1 wherein said overcap comprises a partially hollow decorative head above said skirt, said overcap functioning as a finger puppet when removed from said closure cup.

5. The closure according to claim 4 wherein said skirt and said skirt flange form part of the motif of said decorative head.

6. The closure according to claim 1 wherein said neck portion is formed with an external screw thread and said closure cap is formed with a mating internal screw thread, said neck portion flange being beyond said screw thread from said opening.

* * * * *